US007858161B2

(12) United States Patent
Nair et al.

(10) Patent No.: US 7,858,161 B2
(45) Date of Patent: Dec. 28, 2010

(54) FUSIBLE POROUS POLYMER PARTICLES FOR INKJET RECEIVERS

(75) Inventors: Mridula Nair, Penfield, NY (US); Charles L. Bauer, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 726 days.

(21) Appl. No.: 11/863,560

(22) Filed: Sep. 28, 2007

(65) Prior Publication Data

US 2009/0087596 A1 Apr. 2, 2009

(51) Int. Cl.
*B41M 5/40* (2006.01)

(52) U.S. Cl. ..... 428/32.37; 428/32.21; 428/32.22; 428/32.26; 428/32.27; 428/32.28; 428/32.29; 428/32.3; 428/32.31; 428/32.34

(58) Field of Classification Search ..... 428/32.21, 428/32.22, 32.26, 32.27, 32.28, 32.29, 32.3, 428/32.31, 32.34, 32.37
See application file for complete search history.

(56) References Cited

U.S. PATENT DOCUMENTS

| | | | | |
|---|---|---|---|---|
| 4,785,313 | A | 11/1988 | Higuma et al. | |
| 4,832,984 | A | 5/1989 | Hasegawa et al. | |
| 6,497,480 | B1 | 12/2002 | Wexler | |
| 6,820,970 | B2 * | 11/2004 | Long | 347/73 |
| 2003/0085944 | A1 * | 5/2003 | Long et al. | 347/35 |
| 2006/0003115 | A1 * | 1/2006 | DeMejo et al. | 428/32.34 |
| 2007/0043147 | A1 | 2/2007 | Higgins et al. | |
| 2009/0087596 | A1 * | 4/2009 | Nair et al. | 428/32.22 |

FOREIGN PATENT DOCUMENTS

| | | |
|---|---|---|
| EP | 1 188 573 A2 | 3/2002 |
| EP | 0 858 905 B1 | 11/2002 |
| JP | 07-137432 | 5/1995 |

* cited by examiner

*Primary Examiner*—Betelhem Shewareged
(74) *Attorney, Agent, or Firm*—Carl F. Ruoff

(57) ABSTRACT

The present invention is an inkjet recording element including a support having thereon an image-receiving layer having porous fusible polymeric particles including a continuous phase binder polymer and a second phase including hydrocolloid, wherein the particles have a porosity of from 10 to 80 volume percent and a film forming binder.

13 Claims, 2 Drawing Sheets

Porous fusible particles Example 3 printed and cross-sectioned

Porous fusible particles Example 3 printed and cross-sectioned

Nonporous fusible particles Example 2 printed and cross-sectioned

FUSIBLE POROUS POLYMER PARTICLES FOR INKJET RECEIVERS

FIELD OF THE INVENTION

The invention relates generally to the field of inkjet receivers, and in particular to porous polymeric particles. The invention further relates to an inkjet recording element, more particularly to an inkjet recording element containing porous polymeric particles.

BACKGROUND OF THE INVENTION

In a typical inkjet recording or printing system, ink droplets are ejected from a nozzle at high speed towards a recording element or medium to produce an image on the medium. The ink droplets, or recording liquid, generally include a recording agent, such as a dye or pigment, and a large amount of solvent. The solvent, or carrier liquid, typically is made up of water, an organic material such as a monohydric alcohol, a polyhydric alcohol or mixtures thereof.

An inkjet recording element typically includes a support having on at least one surface thereof an ink-receiving or image-forming layer and includes those intended for reflection viewing, which have an opaque support, and those intended for viewing by transmitted light, which have a transparent support. The ink-receiving layer is typically either a porous layer that imbibes the ink via capillary action or a polymer layer that swells to absorb the ink. Transparent swellable hydrophilic polymer layers do not scatter light and therefore afford optimal image density and gamut, but may take an undesirably long time to dry. Porous ink-receiving layers are usually composed of inorganic or organic particles bonded together by a binder. The inorganic particles used are typically expensive colloidal or fumed alumina or silica particles. During the inkjet printing process, ink droplets are rapidly absorbed into the coating through capillary action, and the image is dry-to-touch right after it comes out of the printer. Therefore, porous coatings allow a fast "drying" of the ink and produce a smear-resistant image; however, porous layers, by virtue of the large number of air-particle interfaces, scatter light that may result in lower densities of printed images.

Highly swellable hydrophilic layers can take an undesirably long time to dry, slowing printing speed. Porous layers speed the absorption of the ink vehicle, but often suffer from insufficient gloss and severe dye fade. Porous layers are also difficult to coat without cracking.

Japanese Kokai 07-137432 describes an inkjet paper having an ink-absorbing layer containing polyester resin particles with internal pores. However, there is a problem with this element in that the average particle size of the polyester resin is greater than 0.5 microns, and the element will have low surface gloss.

Furthermore, inkjet prints prepared by printing onto inkjet recording elements are subject to environmental degradation. They are especially vulnerable to damage resulting from contact with water and atmospheric gases such as ozone. Ozone can bleach inkjet dyes resulting in loss of density. Porous layers are particularly vulnerable to atmospheric gases in view of the open pores. The damage resulting from the post-imaging contact with water can take the form of water spots resulting from deglossing of the top coat, dye smearing due to unwanted dye diffusion, and even gross dissolution of the image recording layer. To overcome these deficiencies, inkjet prints are often laminated. However, lamination is expensive, requiring a separate roll of material.

Efforts have been made to avoid lamination and yet provide protected inkjet prints by providing an inkjet receiver having an uppermost fusible, porous layer. Such inkjet elements are known in the art. Fusing the upper layer after printing the image has the advantage of both providing a protective overcoat for water and stain resistance and reducing light scatter for improved image quality.

For example, U.S. Pat. Nos. 4,785,313 and 4,832,984 relate to an inkjet recording element comprising a support having thereon an upper fusible, porous ink-transporting layer and a lower swellable polymeric ink-retaining layer, wherein the ink-retaining layer is non-porous.

EP 858905A1 relates to an inkjet recording element having a fusible porous ink-transporting outermost layer, formed by heat sintering thermoplastic particles, and an underlying porous ink-retaining layer to absorb and retain the ink applied to the outermost layer to form an image. The underlying porous ink-retaining layer is constituted mainly of refractory pigments. After imaging, the outermost layer is made non-porous.

EP 1,188,573 A2 relates to an inkjet recording material comprising in order: a sheet-like paper substrate, at least one pigment layer coated thereon, and at least one sealing layer coated thereon. Also disclosed is an optional dye-trapping layer present between the pigment layer and the sealing layer.

U.S. Pat. No. 6,497,480 to Wexler discloses inkjet media comprising both a fusible ink-transporting layer and a fusible dye-trapping layer. A base layer under the fusible layers may be employed to absorb ink-carrier-liquid fluid.

It is desirable to provide a cost efficient inkjet recording element comprising porous polymeric particles that perform as an image receiving layer and that can then be fused after printing, thereby obtaining high-density, high quality, images. It is also desirable to provide an improved inkjet printed element having a fused protective layer to render images resistant to water and stain.

It is an objective of this invention to provide an inkjet recording element that is inexpensive yet high quality. It is yet another objective of this invention to provide an inkjet recording element that will provide improved ink uptake speed and allow for faster drying. A further objective of the invention is to provide an inkjet recording element having high surface gloss. Another objective of the invention is to provide an inkjet recording element having a receiving layer that when printed upon has an excellent image quality and stability.

SUMMARY OF THE INVENTION

The present invention is an inkjet recording element including a support having thereon an image-receiving layer having porous fusible polymeric particles including a continuous phase binder polymer and a second phase including hydrocolloid, wherein the particles have a porosity of from 10 to 80 volume percent and a film forming binder.

Figure 1:
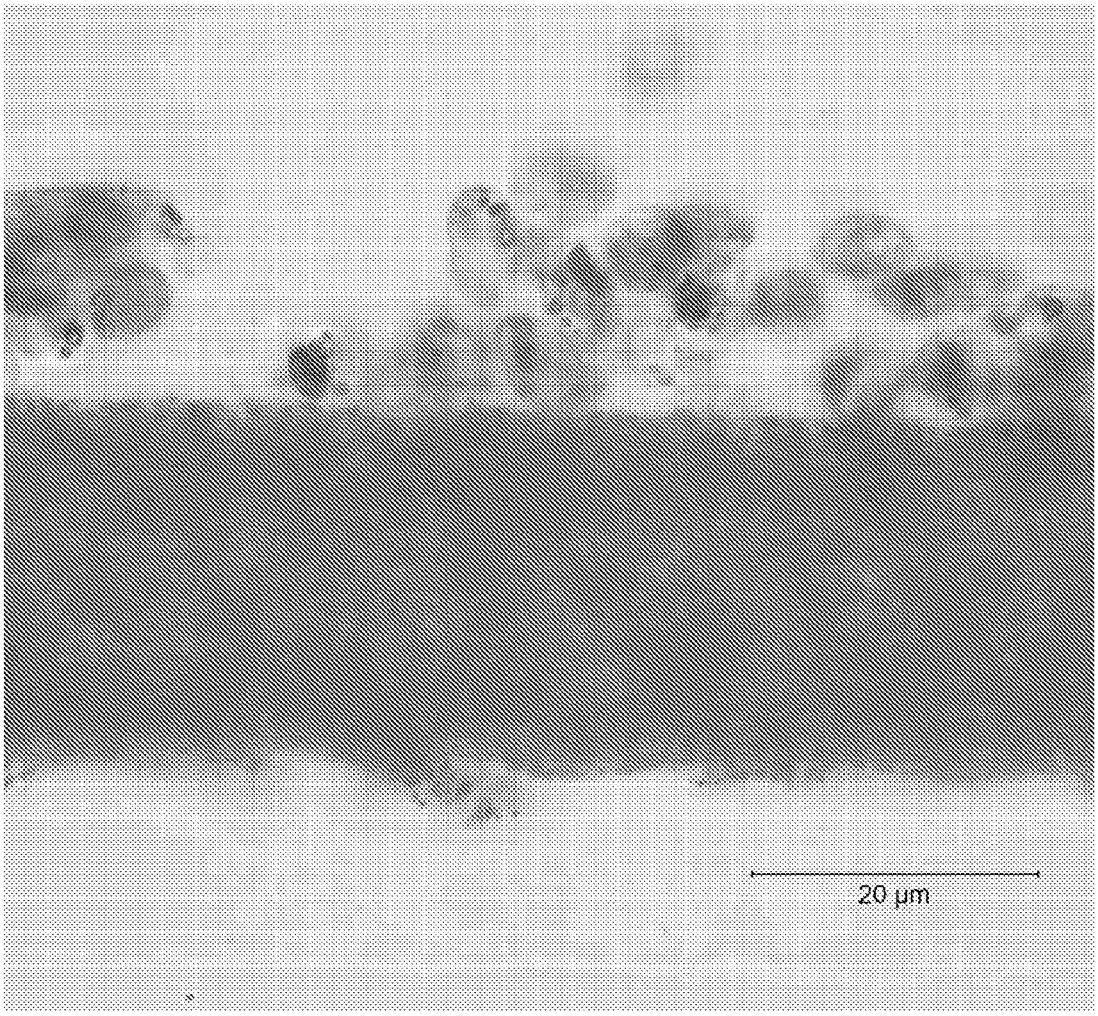
FIG. 1 shows an image element of the present invention wherein the dye has penetrated the porous polymer particles.

For a better understanding of the present invention together with other advantages and capabilities thereof, reference is made to the following description and appended claims in connection with the preceding drawings.

DETAILED DESCRIPTION OF THE INVENTION

Porous fusible polymer particles are used to create the inkjet recording element of this invention comprising a support having thereon an image-receiving layer comprising the porous fusible polymeric particles comprising a continuous phase binder polymer and a second phase comprising hydrocolloid, wherein the particles have a porosity of from 10 to 80 volume percent and a film forming binder. Use of such porous particles in the inkjet recording element will reduce the polymer mass required to create the ink-receiving layer. For example, polymer particles with 50% porosity should require only half as much mass to accomplish the same imaging results. Such particles will fuse faster since only half the mass is present compared to a solid particle of the same size for fusing. Thermal modeling results have shown that going from a 4 micrometer solid to a 4 micrometer porous particle with 50% porosity can increase the fusing process speed by at least 23%. The porous fusible polymer particles are multifunctional in that they can function both as an ink-trapping material and an ink-transporting material. When the ink is trapped in the pores, there is the potential for improved ink stability, particularly for dye-based inks, either through passive trapping via capillary action or in conjunction with dye-mordanting agents in the pores. Hence, polymer particles having an elevated porosity will lower the cost per page and while improving the image quality by providing high gloss and image stability, and save fusing energy.

Porous polymer beads are used in various applications, such as chromatographic columns, ion exchange and adsorption resins, as drug delivery vehicles, scaffolds for tissue engineering, in cosmetic formulations, and in the paper and paint industries. The methods for generating pores inside polymer particles are known in the field of polymer science. However, due to the specific requirements for the fusible inkjet-receiver coatings, such as suitable glass transition temperatures, crosslink density, melt rheology, and sensitivity to particle brittleness that comes from enhanced porosity, the preparation of porous polymer particles is not straightforward. In the present invention, porous particles are prepared using a multiple emulsion process, in conjunction with a suspension process, particularly, the Evaporative Limited Coalescence (ELC) process.

ELC is a process for making polymer particles that are useful among other things as toner particles for electrophotographic printers from a preformed polymer by the chemically prepared toner process. ELC offers many advantages over the conventional grinding method of producing toner particles. In this process, polymer particles having a narrow size distribution are obtained by forming a solution of a polymer in a solvent that is immiscible with water, dispersing the solution so formed in an aqueous medium containing a solid colloidal stabilizer and removing the solvent. The resultant particles are then isolated, washed and dried.

In the practice of this technique, polymer particles are prepared from any type of polymer that is soluble in a solvent that is immiscible with water. Thus, the size and size distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by mechanical shearing using rotor-stator type colloid mills, high pressure homogenizers, agitation etc.

Limited coalescence techniques of this type have been described in numerous patents pertaining to the preparation of electrostatic toner particles because such techniques typically result in the formation of polymer particles having a substantially uniform size distribution. Representative limited coalescence processes employed in toner preparation are described in U.S. Pat. Nos. 4,833,060 and 4,965,131 to Nair et al., incorporated herein by reference for all that they contain.

The porous particles of the present invention include "micro", "meso" and "macro" pores which according to the International Union of Pure and Applied Chemistry are the classifications recommended for pores less than 2 nm, 2 to 50 nm, and greater than 50 nm respectively. The term porous particles will be used herein to include pores of all sizes, including open or closed pores.

Upon fusing the polymer particles of this invention, the air-polymer interfaces present in the original porous structure of the layer are substantially eliminated and a non-scattering, substantially continuous, protective overcoat forms over the image.

The process for making the porous polymer particles of this invention involves basically a three-step process. The first step involves the formation of a stable water-in-oil emulsion, including a first aqueous solution of a pore stabilizing hydrocolloid dispersed finely in a continuous phase of a binder polymer dissolved in an organic solvent. This first water phase creates the pores in the particles of this invention and the pore stabilizing compound controls the pore size and number of pores in the particle, while stabilizing the pores such that the final particle is not brittle or fractured easily.

In the practice of this invention, suitable pore stabilizing hydrocolloids include both naturally occurring and synthetic, water-soluble or water-swellable polymers such as, cellulose derivatives e.g., Carboxymethyl Cellulose (CMC) also referred to as sodium carboxy methyl cellulose, gelatin e.g., alkali-treated gelatin such as cattle bone or hide gelatin, or acid treated gelatin such as pigskin gelatin, gelatin derivatives e.g., acetylated gelatin, phthalated gelatin, and the like, substances such as proteins and protein derivatives, synthetic polymeric binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, water soluble microgels, polyelectrolytes and mixtures thereof.

In order to stabilize the initial first step water-in-oil emulsion so that it can be held without ripening or coalescence, if desired, it is preferable that the hydrocolloid in the water phase have a higher osmotic pressure than that of the binder in the oil phase depending on the solubility of water in the oil. This dramatically reduces the diffusion of water into the oil phase and thus the ripening caused by migration of water between the water droplets. One can achieve a high osmotic pressure in the water phase either by increasing the concentration of the hydrocolloid or by increasing the charge on the hydrocolloid (the counter-ions of the dissociated charges on the hydrocolloid increase the osmotic pressure of the hydrocolloid). It can be advantageous to have weak base or weak acid moieties in the pore stabilizing hydrocolloid that allow for the osmotic pressure of the hydrocolloid to be controlled by changing the pH. We call these hydrocolloids "weakly dissociating hydrocolloids". For these weakly dissociating hydrocolloids the osmotic pressure can be increased by buffering the pH to favor dissociation, or by simply adding a base (or acid) to change the pH of the water phase to favor dissociation. A preferred example of such a weakly dissociating hydrocolloid is CMC that has a pH sensitive dissociation (the carboxylate is a weak acid moiety). For CMC the osmotic pressure can be increased by buffering the pH, for example using a pH 6-8 phosphate buffer, or by simply adding a base to raise the pH of the water phase to favor dissociation (for CMC the osmotic pressure increases rapidly as the pH is increased from 4-8).

Other synthetic polyelectrolytes hydrocolloids such as polystyrene sulphonate (PSS) or poly(2-acrylamido-2-methylpropanesulfonate) (PAMS) or polyphosphates are also possible hydrocolloids. These hydrocolloids have strongly dissociating moieties. While the pH control of osmotic pressure that can be advantageous, as described above, is not possible due to the strong dissociation of charges for these strongly dissociating polyelectrolyte hydrocolloids, these systems will be insensitive to varying level of acid impurities. This is a potential advantage for these strongly dissociating polyelectrolyte hydrocolloids particularly when used with binder polymers that have varying levels of acid impurities such as polyesters.

The essential properties of the pore stabilizing hydrocolloids are solubility in water, no negative impact on multiple emulsification process, and no negative impact on melt rheology of the resulting particles that is important in fusing of the particles after printing. The pore stabilizing compounds can be optionally cross-linked in the pore to minimize migration of the compound to the surface. The amount of the hydrocolloid used in the first step will depend on the amount of porosity and size of pores desired and the molecular weight of the hydrocolloid. A particularly preferred hydrocolloid is CMC and in an amount of from 0.5-20 weight percent of the binder polymer, preferably in an amount of from 1-10 weight percent of the binder polymer.

The first aqueous phase may additionally contain, if desired, salts to buffer the solution and to optionally control the osmotic pressure of the first aqueous phase as described earlier. For CMC the osmotic pressure can be increased by buffering using a pH 7 phosphate buffer. It may also contain additional porogen or pore forming agents such as ammonium carbonate.

As indicated above, the present invention is applicable to the preparation of polymeric particles from any type of binder polymer or binder resin that is capable of being dissolved in a solvent that is immiscible with water wherein the binder itself is substantially insoluble in water. In a preferred embodiment, useful binder polymers include those derived from vinyl monomers, such as styrene monomers, and condensation monomers such as esters and mixtures thereof. As the binder polymer, known binder resins are useable. Concretely, these binder resins include homopolymers and copolymers such as polyesters, polymer derived from styrenes, e.g. styrene and chlorostyrene; monoolefins, e.g. ethylene, propylene, butylene and isoprene; vinyl esters, e.g. vinyl acetate, vinyl propionate, vinyl benzoate and vinyl butyrate; α-methylene aliphatic monocarboxylic acid esters, e.g. methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers, e.g. vinyl methyl ether, vinyl ethyl ether and vinyl butyl ether; and vinyl ketones, e.g. vinyl methyl ketone, vinyl hexyl ketone and vinyl isopropenyl ketone. Particularly desirable binder polymers/resins include polystyrene resin, polyester resin, styrene/alkyl acrylate copolymers, styrene/alkyl methacrylate copolymers, styrene/acrylonitrile copolymer, styrene/butadiene copolymer, styrene/maleic anhydride copolymer, polyethylene resin and polypropylene resin. They further include polyurethane resin, epoxy resin, silicone resin, polyamide resin, modified rosin, paraffins and waxes. Also, especially useful are polyesters of aromatic or aliphatic dicarboxylic acids with one or more aliphatic diols, such as polyesters of isophthalic or terephthalic or fumaric acid with diols such as ethylene glycol, cyclohexane dimethanol and bisphenol adducts of ethylene or propylene oxides.

Preferably, the acid values (expressed as milligrams of potassium hydroxide per gram of resin) of the polyester resins are in the range of 2-100. The polyesters may be saturated or unsaturated. Of these resins, styrene/acryl and polyester resins are particularly preferable.

In the practice of this invention, it is particularly advantageous to utilize resins having a viscosity in the range of 1 to 100 centipoises when measured as a 20 weight percent solution in ethyl acetate at 25° C.

Any suitable solvent that will dissolve the binder polymer and which is also immiscible with water may be used in the practice of this invention such as for example, chloromethane, dichloromethane, ethyl acetate, vinyl chloride, trichloromethane, carbon tetrachloride, ethylene chloride, trichloroethane, toluene, xylene, cyclohexanone, 2-nitropropane and the like. A particularly useful solvent in the practice of this invention are ethyl acetate and propyl acetate for the reason that they are both good solvents for many polymers while at the same time being sparingly soluble in water. Further, their volatility is such that they are readily removed from the discontinuous phase droplets as described below, by evaporation.

Optionally, the solvent that will dissolve the binder polymer and which is immiscible with water may be a mixture of two or more water-immiscible solvents chosen from the list given above. Optionally, the solvent may comprise a mixture of one or more of the above solvents and a water-immiscible nonsolvent for the binder polymer such as heptane, cyclohexane, diethylether and the like, that is added in a proportion that is insufficient to precipitate the binder polymer prior to drying and isolation.

The second step in the formation of the porous particles of this invention involves forming a water-in-oil-in-water emulsion by dispersing the above mentioned water-in-oil emulsion in a second aqueous phase containing either stabilizer polymers such as poylvinylpyrrolidone or polyvinylalchol or more preferably colloidal silica such as LUDOX™ or NALCO™ or latex particles in a modified ELC process described in U.S. Pat. Nos. 4,883,060; 4,965,131; 2,934,530; 3,615,972; 2,932,629 and 4,314,932, the disclosures of which are hereby incorporated by reference.

Specifically, in the second step of the process of the present invention, the water-in-oil emulsion is mixed with the second aqueous phase containing colloidal silica stabilizer to form an aqueous suspension of droplets that is subjected to shear or extensional mixing or similar flow processes, preferably through an orifice device to reduce the droplet size, yet above the particle size of the first water-in-oil emulsion, and achieve narrow size distribution droplets through the limited coalescence process. The pH of the second aqueous phase is generally between 4 and 7 when using silica as the colloidal stabilizer.

The suspension droplets of the first water-in-oil emulsion in the second aqueous phase, results in droplets of binder polymer/resin dissolved in oil containing the first aqueous phase as finer droplets within the bigger binder polymer/resin droplets, which upon drying produces porous domains in the resultant particles of binder polymer/resin. The actual amount of silica used for stabilizing the droplets depends on the size of the final porous particle desired as with a typical limited coalescence process, which in turn depends on the volume and weight ratios of the various phases used for making the multiple emulsion.

Any type of mixing and shearing equipment may be used to perform the first step of this invention, such as a batch mixer, planetary mixer, single or multiple screw extruder, dynamic or static mixer, colloid mill, high pressure homogenizer, sonicator, or a combination thereof. While any high shear type agitation device is applicable to this step of the present invention, a preferred homogenizing device is the MICROFLUIDIZER such as Model No. 110T produced by Micro fluidics Manufacturing. In this device, the droplets of the first water phase (discontinuous phase) are dispersed and reduced in size in the oil phase (continuous phase) in a high shear agitation zone and, upon exiting this zone, the particle size of the dispersed oil is reduced to uniform sized dispersed droplets in the continuous phase. The temperature of the process can be modified to achieve the optimum viscosity for emulsification of the droplets and to control evaporation of the solvent. For the second step, where the water-in-oil-in-water emulsion is formed the shear or extensional mixing or flow process is controlled in order to prevent disruption of the first emulsion and droplet size reduction is achieved by homogenizing the emulsion through a capillary orifice device, or other suitable flow geometry. In the method of this invention, the range of back pressure suitable for producing acceptable particle size and size distribution is between 100 and 5000 psi, preferably between 500 and 3000 psi. The preferable flow rate is between 1000 and 600 mL per minute.

The final size of the particle, the final size of the pores and the surface morphology of the particle may be impacted by the osmotic mismatch between the osmotic pressure of the inner water phase, the binder polymer/resin oil phase and the outer water phase. At each interface, the larger the osmotic pressure gradient present, the faster the diffusion rate where water will diffuse from the lower osmotic pressure phase to the higher osmotic pressure phase depending on the solubility and diffusion coefficient of the water in oil phase. If either the exterior water phase or the interior water phase has an osmotic pressure less than the oil phase then water will diffuse into and saturate the oil phase. For the preferred oil phase solvent of ethyl acetate this can result in approximately 8% by weight water dissolved in the oil phase. If the osmotic pressure of the exterior water phase is higher than the binder phase then the water will migrate out of the pores of the particle and reduce the porosity and particle size. In order to maximize porosity one preferably orders the osmotic pressures so that the osmotic pressure of the outer phase is lowest, while the osmotic pressure of the interior water phase is highest. Thus, the water will diffuse following the osmotic gradient from the external water phase into the oil phase and then into the internal water phase swelling the size of the pores and increasing the porosity and particle size.

If it is desirable to have small pores and maintain the initial small drop size formed in the step one emulsion then the osmotic pressure of both the interior and exterior water phase should be preferably matched, or have a small osmotic pressure gradient. It is also preferable that the osmotic pressure of the exterior and interior water phases be higher than the oil phase. When using weakly dissociating hydrocolloids such as CMC, one can change the pH of the exterior water phase using acid or a buffer preferably a pH 4 citrate buffer. The hydrogen and hydroxide ions diffuse rapidly into the interior water phase and equilibrate the pH with the exterior phase. The drop in pH of the interior water phase containing the CMC thus reduces the osmotic pressure of the CMC. By designing the equilibrated pH correctly one can control the hydrocolloid osmotic pressure and thus the final porosity, size of the pores and particle size.

A way to control the surface morphology as to whether there are open pores (surface craters) or closed pores (a surface shell) is by controlling the osmotic pressure of the two water phases. If the osmotic pressure of the interior water phase is sufficiently low relative to the exterior water phase the pores near the surface may burst to the surface and create an "open pore" surface morphology during drying in the third step of the process.

The third step in the preparation of the porous particles of this invention involves removal of both the solvent that is used to dissolve the binder polymer and most of the first water phase so as to produce a suspension of uniform porous polymer particles in aqueous solution. The rate, temperature and pressure during drying will also impact the final particle size and surface morphology. Clearly the details of the importance of this process depend on the water solubility and boiling point of the organic phase relative to the temperature of drying process. Solvent removal apparatus such as a rotary evaporator or a flash evaporator may be used in the practice of the method of this invention. The polymer particles are isolated after removing the solvent by filtration or centrifugation, followed by drying in an oven at 40° C. that also removes any water remaining in the pores from the first water phase. Optionally, the particles are treated with alkali to remove the silica stabilizer.

Optionally, the third step in the preparation of porous particles described above may be preceded by the addition of additional water prior to removal of the solvent, isolation and drying.

The average particle diameter of the porous polymer particles of the present invention is, for example, 2 to 50 micrometers, preferably 3 to 20 micrometers.

The porosity of the particles is greater than 10%, preferably between 20 and 90% and most preferably between 30 and 70%.

Alternatively, in the process of the present invention, the pore stabilizing hydrocolloid may be emulsified in a mixture of water-immiscible polymerizable monomers, a polymerization initiator and optionally a colorant and a charge control agent to form the first water in oil emulsion. The resulting emulsion may then be dispersed in water containing stabilizer as described in the second step of the process to form a water-in-oil-in-water emulsion preferably through the limited coalescence process. The monomers in the emulsified mixture are polymerized in the third step, preferably through the application of heat or radiation. The resulting suspension polymerized particles may be isolated and dried as described earlier to yield porous particles. In addition the mixture of water-immiscible polymerizable monomers can contain the binder polymers listed previously.

The ink receiving layer of the inkjet element is formed by coating a mixture comprised of these porous polymer particles and a film forming binder in an amount insufficient to alter the porosity of the porous receiving layer onto a support, and then drying to remove approximately all of the volatile components. In a preferred embodiment, the film forming binder is a hydrophilic polymer such as polyvinylpyrrolidone and vinylpyrrolidone-containing copolymers, polyethyloxazoline and oxazoline-containing copolymers, imidazole-containing polymers, polyacrylamides and acrylamide-containing copolymers, poly(vinyl alcohol) and vinyl-alcohol-containing copolymers, poly(vinyl methyl ether), poly(vinyl ethyl ether), poly(alkylene oxides), gelatin, cellulose ethers, poly(vinylacetamides), partially hydrolyzed poly(vinyl acetate/vinyl alcohol), poly(acrylic acid), sulfonated or phosphated polyesters and polystyrenes, casein, albumin, chitin, chitosan, dextran, pectin, collagen derivatives, collodian, agar-agar, arrowroot, guar, carrageenan, tragacanth, xanthan, rhamsan and the like. In another preferred embodiment of the invention, the hydrophilic polymer is hydroxyethyl cellulose, hydroxypropyl cellulose, hydroxypropyl methyl cellulose, methyl cellulose, or a poly(alkylene oxide). In still another preferred embodiment, the film forming binder is a latex such as poly(styrene-co-butadiene), polyurethane, polyester, poly (acrylate), poly(methacrylate), a copolymer of n-butylacrylate and ethylacrylate, and a copolymer of vinylacetate and n-butylacrylate. In still another preferred embodiment, the film forming binder is a water dispersible condensation polymer such as a polyurethane. In still another preferred embodiment, the film forming binder is a condensate of alkoxysilanes or other metal sols such as alumina sol, titania sol, or zirconia sol. Mixtures of the above listed hydrophilic polymers can be used. The film forming binder should be chosen so that it is compatible with the porous particles of this invention.

The amount of film forming binder used should be just sufficient to impart cohesive strength to the fusible polymer particles of the inkjet recording element, and not compromise the porosity imparted by the particles, by excessive water uptake of the binder. In a preferred embodiment of the invention, the fusible porous polymer particles are present in an amount of between 50 and 95% by weight, and most preferably, in an amount between 75 and 90% by weight of the layer.

Since the image recording element may come in contact with other image recording articles or the drive or transport mechanisms of image recording devices, additives such as filler particles, surfactants, lubricants, cross linking agents, matte particles and the like may be added to the element to the extent that they do not degrade the properties of interest.

Filler particles may be used in the ink receiving layer such as silicon oxide, fumed silica, silicon oxide dispersions such as those available from Nissan Chemical Industries and DuPont Corp., aluminum oxide, fumed alumina, calcium carbonate, barium sulfate, barium sulfate mixtures with zinc sulfide, inorganic powders such as γ-aluminum oxide, chromium oxide, iron oxide, tin oxide, doped tin oxide, aluminosilicate, titanium dioxide, silicon carbide, titanium carbide, and diamond in fine powder, as described in U.S. Pat. No. 5,432,050.

A dispersing agent, or wetting agent can be present to facilitate the dispersion of the filler particles. This helps to minimize the agglomeration of the particles. Useful dispersing agents include, but are not limited to, fatty acid amines and commercially available wetting agents such as Solsperse® sold by Zeneca, Inc. (ICI). Preferred filler particles are silicon oxide, aluminum oxide, calcium carbonate, and barium sulfate. Preferably, these filler particles have a median diameter less than 1.0 μm. The filler particles can be present in the amount from about 0 to 80 percent of the total solids in the dried ink receiving layer, most preferably in the amount from about 0 to 40 percent.

The inkjet element may include lubricating agents. Lubricants and waxes useful either in the ink receiving layer or on the side of the element that is opposite the ink receiving layer include, but are not limited to, polyethylenes, silicone waxes, natural waxes such as carnauba, polytetrafluoroethylene, fluorinated ethylene propylene, silicone oils such as polydimethylsiloxane, fluorinated silicones, functionalized silicones, stearates, polyvinylstearate, fatty acid salts, and perfluoroethers. Aqueous or non-aqueous dispersions of submicron size wax particles such as those offered commercially as dispersions of polyolefins, polypropylene, polyethylene, high density polyethylene, microcrystalline wax, paraffin, natural waxes such as carnauba wax, and synthetic waxes from such companies as, but not limited to, Chemical Corporation of America (Chemcor), Inc., Michelman Inc., Shamrock Technologies Inc., and Daniel Products Company, are useful.

In order to obtain adequate coatability, additives known to those familiar with such art such as surfactants, defoamers, alcohol and the like may be used. Coating aids and surfactants include, but are not limited to, nonionic fluorinated alkyl esters such as FC-430®, FC-431®, FC-10®, FC-171® sold by Minnesota Mining and Manufacturing Co., Zonyl® fluorochemicals such as Zonyl-FSN®, Zonyl-FTS®, Zonyl-TBS®, Zonyl-BA® sold by DuPont Corp., other fluorinated polymer or copolymers such as Modiper F600® sold by NOF Corporation, polysiloxanes such as Dow Corning DC 1248®, DC200®, DC510®, DC 190® and BYK 320®, BYK 322®, sold by BYK Chemie and SF 1079®, SF1023®, SF 1054®, and SF 1080® sold by General Electric, and the Silwet® polymers sold by Union Carbide, polyoxyethylene-lauryl ether surfactants, sorbitan laurate, palmitate and stearates such as Span® surfactants sold by Aldrich, poly(oxyethylene-co-oxypropylene) surfactants such as the Pluronic® family sold by BASF, and other polyoxyethylene-containing surfactants such as the Triton X® family sold by Union Carbide, ionic surfactants, such as the Alkanol® series sold by DuPont Corp., and the Dowfax® family sold by Dow Chemical. Specific examples are described in MCCUTCHEON's Volume 1: Emulsifiers and Detergents, 1995, North American Edition. To improve colorant fade, UV absorbers, radical quenchers or antioxidants may also be added to the ink-receiving layer as is well known in the art. Examples include polyalkylenepolyamine-dicyanodiamide based polycondensation products, water soluble reducing agents, such as sulfites, nitrites, phosphates, thiosulfates, ascorbic acid or salts thereof, hydroxylamine derivatives, and glucose, sulfur-containing compounds, such as thiocyanates, thiourea, 2-mercaptobenzimidazole, 2-mercaptobenzthiazole, 2-mercaptobenzoxazole, 5-mercapto-1-methyl-tetrazole, 2,5-dimercapto-1,3,4-triazole, 2,4,6-trimercaptocyanuric acid, thiosalicylic acid, thiouracil, 1,2-bis(2-hydroxyethylthio) ethane, or hydrophobic antioxidant emulsified dispersions, such as hindered phenol based antioxidants, piperidine based antioxidants or hindered amines. UV absorbers include those described in Japanese Patent Publication Open to Public Inspection Nos. 57-74193, 57-87988, and 2-261476, antifading agents include those described in Japanese Patent Publication Open to Public Inspection Nos. 57-74192, 57-87989, 60-72785, 61-146591, 1-95091, and 3-13376.

The ink receiving layer may include pH modifiers, adhesion promoters, rheology modifiers, latexes, biocides, dyes, optical brighteners, whitening agents, described in Japanese Patent Publication Open to Public Inspection Nos. 59-42993, 59-52689, 62-280069, 61-242871, and 4-219266, and antistatic agents.

The fusible polymer particles of this invention as mentioned before may act as an ink trapping material by virtue of the high porosity and, hence, may incorporate one or more mordanting species in the pores. Alternatively, the mordanting species may be present in the ink-receiving layer. The mordant polymer can be a soluble polymer, a charged molecule, or a cross linked dispersed microparticle. The mordant can be non-ionic, cationic or anionic. Examples of a mordant are polymers or copolymers containing a quaternized nitrogen moiety, such as, for example, poly(styrene-co-1-vinylimidazole-co-1-vinyl-3-benzylimidazolium chloride), poly(styrene-co-1-vinylimidazole-co-1-vinyl-3-hydroxyethyl-imidazolium chloride), poly(styrene-co-1-vinylimidazole-co-1-vinyl-3-benzylimidazolium chloride-co-1-vinyl- 3-hydroxyethylimidazolium chloride), poly (vinylbenzyltrimethylammonium chloride-co-divinylbenzene), poly(ethyl acrylate-co-1-vinylimidazole-co-1-vinyl-3-benzylimidazolium chloride), or poly(styrene-co-4-vinylpyridine-co-4-hydroxyethyl-1-vinylpyridinium chloride). In a preferred embodiment of the invention, the quaternary nitrogen moiety incorporated in the polymer is a salt of trimethylvinylbenzylammonium, benzyldimethylvinylbenzylammonium, dimethyloctadecylvinylbenzylammonium, glycidyltrimethylammonium, 1-vinyl-3-benzylimidazolium, 1-vinyl-3-hydroxyethylimidazolium or 4-hydroxyethyl-1-vinylpyridinium. Preferred counter ions that can be used include chlorides or other counter ions as disclosed in U.S. Pat. Nos. 5,223,338; 5,354,813, and 5,403,955, the disclosures of which are hereby incorporated by reference. Other mordants suitable for the invention are cationic modified products of polymers such as poly(vinyl alcohol), gelatin, chitosan, polyvinylamine, polyethyleneimine, polydimethyldiallyl ammonium chloride, polyalkylene-polyamine dicyandiamide ammonium condensate, polyvinylpyridinium halide, polymers of (meth)acryloyl oxyalkyl quaternary ammonium salt, polymers of (meth)acrylamide alkyl quaternary ammonium salt, ω-chloro-poly(oxyethylene-polymethylene quaternary ammonium alkylate), methyl glycol chitosan, poly(vinylpyridine), propylene oxide based triamines of the Jeffamine T series, made by Texaco, Inc., quaternary acrylic copolymer latexes, phosphonium compounds, sulfonamides, sulfonated polymers and dispersed particles, and alumina hydrate. Other mordants suitable for the invention are polymers, copolymers, or latexes containing carboxylic acid, sulfonic acid, sulfonamide, sulfonimides, or phosphonic acid, such as carboxylated and sulfonated acrylates or methacrylates, carboxylated styrene butadienes, sulfonated nylons, polyesters and polyurethanes, and their salts.

The ink receiving element may contain multiple individual ink receiving layers. Each being comprised of a different composition, combinations of porous polymer particles with differing mean diameters, and layer thickness.

The total thickness of the ink receiving layer(s) may range from about 5 to about 100 μm, preferably from about 10 to about 50 μm. The coating thickness required is determined through the need for the coating to act as a sump for absorption of ink solvent and the need to hold the ink near the coating surface.

In addition to the ink receiving layer, the recording element may also contain a base layer, next to the support, the function of which is to absorb the solvent from the ink. Materials useful for this layer include inorganic particles and polymeric binder, or highly swellable polymers such as gelatin.

The support for the inkjet recording element used in the invention can be any of those usually used for inkjet receivers. The support can be either transparent or opaque. Opaque supports include plain paper, coated paper, resin-coated paper such as polyolefin-coated paper, synthetic paper, photographic paper support, melt-extrusion-coated paper, and polyolefin-laminated paper, such as biaxially oriented support laminates. Biaxially oriented support laminates are described in U.S. Pat. Nos. 5,853,965; 5,866,282; 5,874,205; 5,888,643; 5,888,681; 5,888,683 and 5,888,714, the disclosures of which are hereby incorporated by reference. These biaxially oriented supports include a paper base and a biaxially oriented polyolefin sheet, typically polypropylene, laminated to one or both sides of the paper base. The support can also consist of micro porous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Transparent supports include glass, cellulose derivatives, such as a cellulose ester, cellulose triacetate, cellulose diacetate, cellulose acetate propionate, cellulose acetate butyrate, polyesters, such as poly(ethylene terephthalate), poly(ethylene naphthalate), poly-1,4-cyclo-hexanedi-methylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The papers listed above include a broad range of papers, from high end papers, such as photographic paper to low end papers, such as newsprint. In a preferred embodiment, Ektacolor paper made by Eastman Kodak Co. is employed. The term as used herein, "transparent" means the ability to pass radiation without significant deviation or absorption.

The support used in the invention may have a thickness of from about 50 to about 500 μm, preferably from about 75 to 300 μm. Antioxidants, brightening agents, antistatic agents, plasticizers and other known additives may be incorporated into the support, if desired.

In order to improve the adhesion of the ink receiving layer to the support, an under-coating or subbing layer may be applied to the surface of the support. This layer may be an adhesive layer such as, for example, halogenated phenols, partially hydrolyzed vinyl chloride-co-vinyl acetate polymer, vinylidene chloride-methyl acrylate-itaconic acid terpolymer, a vinylidene chloride-acrylonitrile-acrylic acid terpolymer, or a glycidyl(meth)acrylate polymer or copolymer. Other chemical adhesives, such as polymers, copolymers, reactive polymers or copolymers, that exhibit good bonding between the ink receiving layer and the support can be used. The polymeric binder in the subbing layer employed in the invention is preferably a water soluble or water dispersible polymer such as poly(vinyl alcohol), poly(vinyl pyrrolidone), gelatin, a cellulose ether, a poly(oxazoline), a poly(vinylacetamide), partially hydrolyzed poly(vinyl acetate/vinyl alcohol), poly(acrylic acid), poly(acrylamide), poly(alkylene oxide), a sulfonated or phosphated polyester or polystyrene, casein, zein, albumin, chitin, chitosan, dextran, pectin, a collagen derivative, collodian, agar-agar, arrowroot, guar, carrageenan, tragacanth, xanthan, rhamsan and the like, a latex such as poly(styrene-co-butadiene), a polyurethane latex, a polyester latex, or a poly(acrylate), poly(methacrylate), poly (acrylamide) or copolymers thereof.

Other methods to improve the adhesion of the layer to the support include surface treatment of the support by corona discharge, plasma-treatment in a variety of atmospheres, UV treatment, which is performed prior to applying the layer to the support.

The recording element of the invention can contain one or more conducting layers such as an antistatic layer to prevent undesirable static discharges during manufacture and printing of the image. This may be added to either side of the element. Antistatic layers conventionally used for color films have been found to be satisfactory, such as those in U.S. Pat. No. 5,147,768, the disclosure of which is hereby incorporated by reference. Preferred antistatic agents include metal oxides, e.g., tin oxide, antimony doped tin oxide and vanadium pentoxide. These antistatic agents are preferably dispersed in a film-forming binder.

The layers described above may be coated by conventional coating means onto a support material commonly used in this art. Coating methods may include, but are not limited to, wound wire rod coating, knife coating, slot coating, slide hopper coating, gravure coating, spin coating, dip coating, skim-pan-air-knife coating, multilayer slide bead, doctor blade coating, gravure coating, reverse-roll coating, curtain coating, multilayer curtain coating and the like. Some of these methods allow for simultaneous coatings of more than one layer, which is preferred from a manufacturing economic perspective if more than one layer or type of layer needs to be applied. Known coating and drying methods are described in further detail in Research Disclosure no. 308119, published December 1989, pages 1007 to 1008. Slide coating is preferred, in which several layers may be simultaneously applied. The support may be stationary, or may be moving so that the coated layer is immediately drawn into drying chambers. After coating, the layers are generally dried by simple evaporation, which may be accelerated by known techniques such as convection heating.

The coating composition may be applied to one or both substrate surfaces through conventional pre-metered or post-metered coating methods listed above. The choice of coating process would be determined from the economics of the operation and, in turn would determine the formulation specifications such as coating solids, coating viscosity, and coating speed.

In yet another preferred embodiment of this invention, the inkjet element is formed by depositing the fusible porous particles onto a support using electrostatic deposition followed by inkjet printing and fusing resulting in a glossy printed element.

Inkjet inks used to image the recording elements of the present invention are well known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for inkjet printers, they also can be used as recording media for pen plotter assemblies. Pen plotters operate by writing directly on the surface of a recording medium using a pen consisting of a bundle of capillary tubes in contact with an ink reservoir.

The following examples are intended to further illustrate, but not to limit the invention.

The Kao Binder E, a polyester resin, used in the examples below was obtained from Kao Specialties Americas LLC a part of Kao Corporation, Japan. Carboxymethyl cellulose molecular weight approximately 250 K as the sodium salt, was obtained from Acros Organics. NALCO 1060™, a colloidal silica, was obtained from DuPont as a 50 weight percent dispersion.

The particle size distribution was characterized by a Coulter Particle Analyzer. The volume median value from the Coulter measurements was used to represent the particle size of the particles described in these examples.

The level of porosity of the particles of the present invention was measured using a combination of methods. The outside or overall diameter of the particles is easily measured with a number of aforementioned particle measurement techniques, but determining the extent of particle porosity can be problematic. Determining particle porosity using typical gravitational methods can be problematic due to the size and distribution of pores in the particles and whether or not some pores break through to the particle surface. To accurately determine the extent of porosity in the particles of the present invention a combination of conventional diameter sizing and time-of-flight methods was used. Conventional sizing methods include total volume displacement methods such as Coulter particle sizers or image based methods such as the Sysmex FPIA3000 system. The time-of-flight method used to determine the extent of porosity of the particles in the present invention includes the Aerosizer particle measuring system. The Aerosizer measures particle sizes by their time-of-flight in a controlled environment. This time of flight depends critically on the density of the material. If the material measured with the Aerosizer has a lower density due to porosity or a higher density due, for example, to the presence of fillers, then the calculated diameter distribution will be shifted artificially low or high respectively. Independent measurements of the true particle size distribution via alternate methods (e.g. Coulter or Sysmex) can then be used to fit the Aerosizer data with particle density as the adjustable parameter. The method of determining the extent of particle porosity of the particles of the present invention is as follows. The outside diameter particle size distribution is first measured using either the Coulter or Sysmex particle measurement systems. The mode of the volume diameter distribution is chosen as the value to match with the Aerosizer volume distribution. The same particle distribution is measured with the Aerosizer and the apparent density of the particles is adjusted until the mode (D50%) of the two distributions matches. The ratio of the calculated and solid particle densities is taken to be the extent of porosity of the particles. The porosity values generally have uncertainties of +/−10%.

EXAMPLES

Preparation of Fusible Porous Particles P1

The porous polymer particles of this invention were made using the following general procedure:

CMC molecular weight 250K (28.5 grams) was dissolved in 571.5 grams of distilled water. This was dispersed in 1942 grams of ethyl acetate containing 388 grams of the Kao E polymer resin for two minutes at 6800 RPM using a Silverson L4R homogenizer fitted with the General-Purpose Disintegrating Head. The resultant water-in-oil emulsion was further homogenized using a Microfluidizer Model #110T from Microfluidics at a pressure of 8900 psi. A 1830 g aliquot of the resultant very fine water-in-oil emulsion was dispersed, using the Silverson homogenizer again for two minutes at 2800 RPM, in 3168 grams of the second water phase comprising a pH 4 buffer and 168 grams of NALCO 1060™, followed by homogenization in a APV Crepaco homogenizer to form a water-in-oil-in-water double emulsion. The ethyl acetate was evaporated using a Heidolph Laborata rotary evaporator at 40° C. under reduced pressure. The resulting suspension of beads were filtered using a glass fritted funnel, washed with water several times and re-suspended in water. The volume median particle size was 8.5 micrometers and the porosity was approximately 50 percent.

Preparation of Fusible Nonporous Particles P2 (Check 1)

The non-porous solid particles were made by a conventional ELC, chemical process. The particle size was 10 microns and the measured porosity was less than 4 percent.

The 4 percent adjustment required to match distributions is within the uncertainty of the measurements.

Example 1

Preparation of Ink Receiving Element 1

A coating composition A was prepared by mixing together 25.5 g of 9.3 wt % of P1 dispersion, 1.31 g of a 9.53 wt % solution of polyvinyl alcohol (GH23 from Nippon Gohsei) as the film forming binder and 0.2 g of a 10 wt % of Olin 10G as a surfactant. This solution was coated onto a support using either a knife blade or wire wound rod depending on the thickness of the coating desired, being either 1.45, 3.0 or 30 micrometers thick. The supports used were either a polyethylene resin coated (RC) photographic paper base or a commercial office paper, Hammermill Office One. The coatings were made on a coating block heated to 50° C. and left of the heated block until the coatings were dry to the touch.

Dmax density targets were printed onto the dried coatings using a Canon S520 inkjet printer with the Canon 3E series dye based inks. After printing, Status A density was measured using an X-rite densitometer. 20 and 60° C. Gloss measurements were performed using a BYK-Gardner Micro Tri Glossmeter. The ink receiving layer was then fused and glossed by belt fusing the element at 135° C., 483 kPa, 1.27 cm/min.

For comparisons, printed samples using the Hammermill Office One and Kodak Premium Photo Paper (control for the resin coated paper support sample) were prepared and Dmax densities and gloss measured. The samples were not subjected to the glossing conditions. The results are given in Table 1 below. These results show that as coated, the porous particles provide printed densities comparable to the comparison conventional inkjet receivers. After fusing and glossing, the invention coatings have better densities and higher gloss than the comparison samples.

TABLE 1

| | Support | Porous Fusible layer thickness (um) | Fused and glossed | Dmax Density C | M | Y | Gloss Dmin area 20° | 60° |
|---|---|---|---|---|---|---|---|---|
| Example 1 | RC Paper | 30 | No | 0.85 | 1.06 | 1.00 | 1 | 3 |
| Example 1 | RC Paper | 30 | Yes | 1.04 | 1.47 | 1.31 | 74 | 86 |
| Comparison | Kodak Premium Photo Paper | none | No | 0.93 | 1.50 | 1.11 | 23 | 55 |
| Example 1 | Hammermill Office 1 | 1.45 | No | 0.57 | 0.76 | 0.70 | 1 | 3 |
| Example 1 | Hammermill Office 1 | 1.45 | Yes | 1.19 | 1.62 | 1.30 | 82 | 93 |
| Example 1 | Hammermill Office 1 | 3 | No | 0.56 | 0.76 | 0.69 | 1 | 3 |
| Example 1 | Hammermill Office 1 | 3 | Yes | 1.20 | 1.73 | 1.40 | 82 | 90 |
| Comparison | Hammermill Office 1 | none | No | 0.80 | 1.05 | 0.96 | 3 | 17 |

Example 2

Preparation of Ink Receiving Element 2

A coating composition similar to A was prepared using the nonporous fusible particles P2 (25.5 g of a 9 wt % solution) and 1.25 g of a 10 wt % solution of polyvinyl alcohol (GH23 from Nippon Gohsei) as the film forming binder and 0.2 g of a 10 wt % of Olin 10G as a surfactant, and coated as described in Example 1 on a corona discharge treated resin coated photographic paper base using a knife blade with a 0.254 mm gap to give approximately a 30 micron thick coating after drying.

Example 3

Preparation of Ink Receiving Element 3

A coating similar to Element 2 was made using the porous particles P1.

It was observed that the coating solutions made with the P2 particles in Example 2 quickly settled out of solution and, therefore, resulted in less than uniform coatings when compared with the coatings made with the porous particles P1 in Example 3.

Dmax density targets were printed onto the dried coatings using a Canon S520 inkjet printer with the Canon 3E series dye based inks. After printing, Status A densities were measured using an X-rite densitometer. 20 and 60° Gloss measurements were made using a BYK-Gardner Micro Tri Gloss-meter. The samples were then fused using a belt fuser at 135° C., 483 kPa, 1.27 cm/min.

The results are given in Table 2 below. These results show there is not a significant density or gloss difference between the porous and solid particles which points to no adverse effects with the porosity in terms of haze after fusing.

TABLE 2

| | | Fusible layer thickness | | Dmax Density | | | Gloss Dmin area | |
|---|---|---|---|---|---|---|---|---|
| | Support | (um) | Fused | C | M | Y | 20° | 60° |
| Porous | RC Paper | 30 | No | 0.99 | 1.18 | 1.02 | 1 | 3 |
| Porous | RC Paper | 30 | Yes | 1.26 | 1.70 | 1.35 | 93 | 99 |
| Solid | RC Paper | 30 | No | 1.07 | 1.28 | 1.11 | 1 | 3 |
| Solid | RC Paper | 30 | Yes | 1.20 | 1.65 | 1.33 | 80 | 95 |

Figure 2:
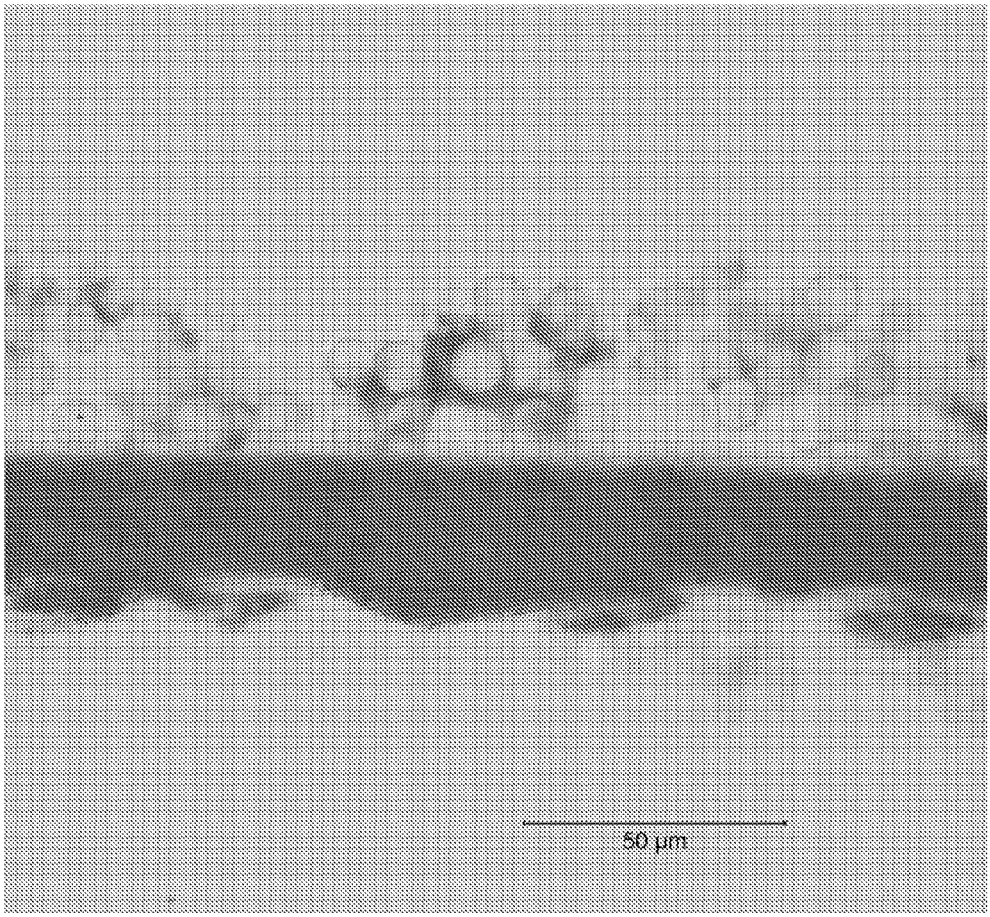
FIG. 2 shows an image element containing non-porous polymer particles wherein ink channeled around the particles.

Cross-sections taken from the printed samples of the check Example 2 and the corresponding ones from Example 3 were examined to determine the fate of the dye. As can be seen in FIGS. 1 and 2, the dye clearly penetrated the pores in Example 3 and were trapped in the pores, while in Example 2 the ink channeled around the beads.

The invention has been described in detail with particular reference to certain preferred embodiments thereof, but it will be understood that variations and modifications can be effected within the spirit and scope of the invention.

What is claimed is:

1. An inkjet recording element comprising a support having thereon an image-receiving layer comprising porous fusible polymeric particles comprising a continuous phase binder polymer and a second phase comprising hydrocolloid, wherein the particles have a porosity of from 10 to 80 volume percent and a film forming binder.

2. The inkjet recording element of claim 1 wherein the continuous phase binder polymer comprises polymers formed from vinyl monomers, condensation monomers, condensation esters and mixtures thereof.

3. The inkjet recording element of claim 1 wherein the continuous phase binder polymer is selected from the group consisting of polyesters, and homo and copolymers of styrenes, monoolefins, vinyl esters, α-methylene aliphatic monocarboxylic acid esters, vinyl ethers and vinyl ketones.

4. The inkjet recording element of claim 1 wherein the Tg of said fusible polymeric particle is from about 40° C. to about 100° C.

5. The inkjet recording element of claim 1 wherein said film forming binder is selected from the group consisting of polyvinylpyrrolidone containing copolymers, vinylpyrrolidone containing copolymers, polyethyloxazoline containing copolymers, oxazoline containing copolymers, imidazole-containing polymers, polyacrylamides containing copolymers, acrylamide containing copolymers, poly(vinyl alcohol), vinyl-alcohol-containing copolymers, poly(vinyl methyl ether), poly(vinyl ethyl ether), poly(alkylene oxides), gelatin, cellulose ethers, poly(vinylacetamides), partially hydrolyzed poly(vinyl acetate/vinyl alcohol), poly(acrylic acid), polyesters, polystyrenes, casein, albumin, chitin, chitosan, dextran, pectin, collagen derivatives, collodian, agar-agar, arrowroot, guar, carrageenan, tragacanth, xanthan, rhamsan, hydroxyethyl cellulose, hydroxypropyl cellulose, hydroxypropyl methyl cellulose, methyl cellulose, or a poly (alkylene oxide), latexes, polyurethanes and condensates of alkoxysilanes or other metal sols.

6. The inkjet recording element of claim 1 wherein said film-forming binder comprises from about 2.5% to about 50 weight % image receiving layer.

7. The inkjet recording element of claim 1 wherein said image-receiving layer has a thickness of about 5 microns to about 100 microns.

8. The inkjet recording element of claim 1 wherein said support is selected from the group consisting of paper, synthetic paper, photographic paper support, melt-extrusion-coated paper, and polyolefin-laminated paper, such as biaxially oriented support laminate, glass, cellulose derivatives, polyesters, polyimides, polyamides, polycarbonates, polystyrene, polyolefins, polysulfones, polyacrylates and polyether imides.

9. The inkjet recording element of claim 1 further comprising a subbing layer disposed on said support.

10. The inkjet recording element of claim 1 further comprising an antistatic layer disposed on said support.

11. The inkjet recording element of claim 1 wherein the imaging layer further comprises filler particles, surfactants, lubricants, cross-linking agents or matte particles.

12. The inkjet recording element of claim 1 wherein the imaging layer further comprises pH modifiers, adhesion promoters, rheology modifiers, latexes, biocides, dyes, mordants, optical brighteners or whitening agents.

13. The inkjet recording element of claim 1 wherein the fusible polymer particles further comprise mordants.

* * * * *